US007484835B2

(12) United States Patent
Kim et al.

(10) Patent No.: US 7,484,835 B2
(45) Date of Patent: Feb. 3, 2009

(54) FILTER PLATE USABLE WITH AN INK JET HEAD, AN INK JET HEAD WITH THE FILTER PLATE, AND A METHOD OF FABRICATING THE FILTER PLATE

(75) Inventors: Kwang-Ryul Kim, Suwon-si (KR); Myong-Jong Kwon, Suwon-si (KR); Kyong-Il Kim, Seoul (KR); Nam-Kyun Kim, Seongnam-si (KR); Byung-Ha Park, Suwon-si (KR); Yong-Shik Park, Seongnam-si (KR); Eun-Bong Han, Suwon-si (KR); Young-Ung Ha, Suwon-si (KR); Sung-Joon Park, Suwon-si (KR); Jao-Sik Min, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 419 days.

(21) Appl. No.: 11/224,281

(22) Filed: Sep. 13, 2005

(65) Prior Publication Data

US 2006/0055739 A1 Mar. 16, 2006

(30) Foreign Application Priority Data

Sep. 13, 2004 (KR) ..... 10-2004-0073182

(51) Int. Cl.
*B41J 2/05* (2006.01)
*B41J 2/175* (2006.01)

(52) U.S. Cl. ..... 347/67; 347/56; 347/93

(58) Field of Classification Search ..... 347/54, 347/56, 67, 93
See application file for complete search history.

(56) References Cited

U.S. PATENT DOCUMENTS 5,154,815 A 10/1992 O'Neill (Continued)

FOREIGN PATENT DOCUMENTS

JP 09-94978 4/1997

(Continued)

OTHER PUBLICATIONS

Korean Office Action dated Feb. 27, 2006 issued in KR 2004-73182.
Chinese Office Action dated Nov. 30, 2007 issued in CN 2005100995222.

*Primary Examiner*—An H Do
(74) *Attorney, Agent, or Firm*—Stanzione & Kim, LLP

(57) ABSTRACT

A filter plate usable with an ink jet head, an ink jet head with the filter plate, and a method of fabricating the filter plate are provided. The filter plate includes a filter substrate having a filter hole region. Filter holes having angled line shapes extend through the filter substrate of the filter hole region. Each of the filter holes may include an upper filter hole formed to have a first angle with respect to the filter substrate at an upper portion of the filter substrate, and a lower filter hole formed at a lower portion of the filter substrate to be connected to the upper filter hole and having a second angle with respect to the filter substrate different from the first angle.

22 Claims, 11 Drawing Sheets

U.S. PATENT DOCUMENTS

| | | | |
|---|---|---|---|
| 5,463,413 | A | 10/1995 | Ho et al. |
| 6,084,618 | A | 7/2000 | Baker |
| 6,199,980 | B1 | 3/2001 | Fisher et al. |
| 6,626,522 | B2 | 9/2003 | Rapp et al. |
| 2003/0026381 | A1 | 2/2003 | Ukai et al. |

FOREIGN PATENT DOCUMENTS

| | | |
|---|---|---|
| JP | 10-6514 | 1/1998 |
| JP | 2002-248772 | 9/2002 |
| KR | 2003-50477 | 6/2003 |

FILTER PLATE USABLE WITH AN INK JET HEAD, AN INK JET HEAD WITH THE FILTER PLATE, AND A METHOD OF FABRICATING THE FILTER PLATE

CROSS-REFERENCE TO RELATED APPLICATIONS

This application claims the benefit of Korean Patent Application No. 2004-73182, filed Sep. 13, 2004, the disclosure of which is hereby incorporated herein by reference in its entirety.

BACKGROUND OF THE INVENTION

1. Field of the Invention

The present general inventive concept relates to an ink jet head and, more particularly, to a filter plate usable with an ink jet head, an ink jet head with the filter plate, and a method of fabricating the filter plate.

2. Description of the Related Art

An ink jet recording device is a device for printing an image by ejecting fine droplets of ink to desired positions on a recording medium. The ink jet recording device has been widely used since it is inexpensive and is capable of printing numerous colors at a high resolution. The ink jet recording device includes an ink jet head for ejecting the ink and an ink container for storing the ink to be supplied to the ink jet head. The ink jet head includes a substrate having a chip shape, and a flow path structure disposed on the substrate to define a shape of an ink flow path including an ink chamber and a nozzle. In addition, the ink chamber is connected to the ink container by a common feedhole extending through the substrate.

One of the problems that affects the ink jet head is clogging of the ink flow path due to particles. The particles may be introduced into the ink flow path during a manufacturing process of the ink jet head or the particles may be contained in the ink. When the particles have a dimension larger than that of the ink flow path, the ink flow path is blocked by the particles, thereby deteriorating quality of a print image, and in some cases, preventing the ink jet head from ejecting the ink. In an attempt to solve the problem described above, a stainless steel mesh filter has been adapted to a conventional ink container to prevent the particles from being introduced into the ink flow path from the ink container. However, in order to obtain a high resolution print image, ink droplet sizes have been reduced by reducing the size of the ink flow path. As a result of this reduction in size of the ink flow path, it has become difficult to use the mesh filter due to a limitation of cost and process.

A method of forming filtering members on an ink jet head substrate during a manufacturing process of the ink jet head has also been developed. Examples of the ink jet head including the filtering members are disclosed in U.S. Pat. Nos. 5,463,413 and 6,626,522. The ink jet heads disclosed in U.S. Pat. Nos. 5,463,413 and 6,626,522 include a chamber layer disposed on a substrate to define an ink chamber and having a three-sided barrier structure. The filtering members are provided in an island shape between a common feedhole extending through a center portion of the substrate and the chamber layer. The filtering members are formed on the same plane of the substrate in the same process as the chamber layer. However, according to U.S. Pat. Nos. 5,463,413 and 6,626,522, it may be difficult to filter the particles having a high aspect ratio. In addition, since the filtering members are formed on the same plane of the substrate as the chamber layer, it may be difficult to fabricate the ink jet head with high density. Furthermore, using the filtering members disclosed in the U.S. Pat. Nos. 5,463,413 and 6,626,522, it may be impossible to adapt the ink jet head to have a structure in which the ink that is supplied from the ink container is introduced through a bottom surface of the ink chamber.

SUMMARY OF THE INVENTION

The present general inventive concept provides a filter plate usable with an ink jet head and a method of fabricating the same, which can effectively filter particles having various shapes and sizes.

The present general inventive concept also provides an ink jet head including the filter plate.

Additional aspect and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a filter plate usable with an ink jet head. The filter plate includes a filter substrate having a filter hole region. Filter holes having angled line shapes extend through the filter substrate of the filter hole region.

Each of the filter holes may include an upper filter hole formed to have a first angle with respect to the filter substrate at an upper portion of the filter substrate, and a lower filter hole formed at a lower portion of the filter substrate to be connected to the upper filter hole and having a second angle with respect to the filter substrate different from the first angle.

The filter substrate may be made of silicon, metal, or polymer.

The filter plate includes the filter holes having cross-sectional areas of about 1 $um^2$ (micrometer)~100 $um^2$.

The filter plate may further include partitions disposed on the filter substrate in order to divide the filter holes into predetermined units. In this case, the partitions may be disposed in the filter hole region to have a length that extends across the filter hole region.

The foregoing and/or other aspects and advantages of the present general inventive concept are also achieved by providing a method of fabricating a filter plate usable with an ink jet head. The method includes preparing a filter substrate having a filter hole region. Then, the filter substrate of the filter hole region is patterned from a top surface to form upper filter holes having a predetermined depth from the top surface of the filter substrate and having a first angle with respect to the filter substrate. A lower portion of the filter substrate is patterned from a bottom surface of the filter substrate to form lower filter holes connected to the upper filter hole and having a second angle with respect to the filter substrate different from the first angle.

The filter substrate may be made of silicon, metal, or polymer.

The forming of the upper filter holes may be performed by a dry etching, wet etching, or laser etching process.

The forming of the lower filter holes may be performed by a laser etching process. In this case, the laser etching process may be performed using an excimer laser, a diode-pumped solid state (DPSS) laser, or a femto-second (FS) laser.

Before the forming of the upper filter hole, partitions may be formed on the filter substrate. In this case, the upper filter holes are divided by the partitions into predetermined units.

The foregoing and/or other aspects and advantages of the present general inventive concept are also achieved by providing an ink jet head including the filter plate. The ink jet head includes nozzles to eject ink, and ink chambers in fluid communication with the nozzles, respectively. A common feedhole formed at a head chip substrate is in fluid communication with the ink chambers. A filter substrate having a filter hole region is disposed on a bottom surface of the head chip substrate. The filter holes having angled line shapes extend through the filter substrate of the filter hole region.

The filter hole region may overlap with the common feedhole to filter the ink supplied thereto.

The ink jet head may further include ink via-holes formed at an upper region of the head chip substrate to connect the common feedhole to the ink chambers. In this case, the partitions to divide the filter holes into predetermined units may be disposed on the filter substrate between adjacent ink via-holes.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
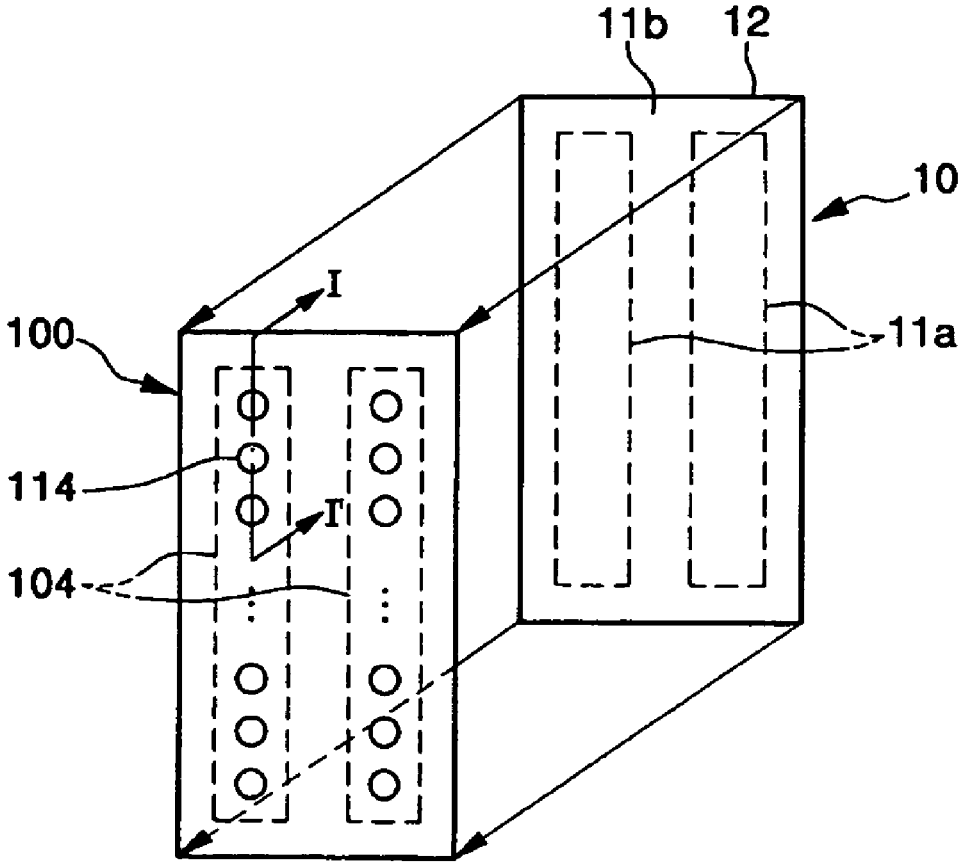
FIG. 1 is an exploded plan view schematically illustrating an ink jet head according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
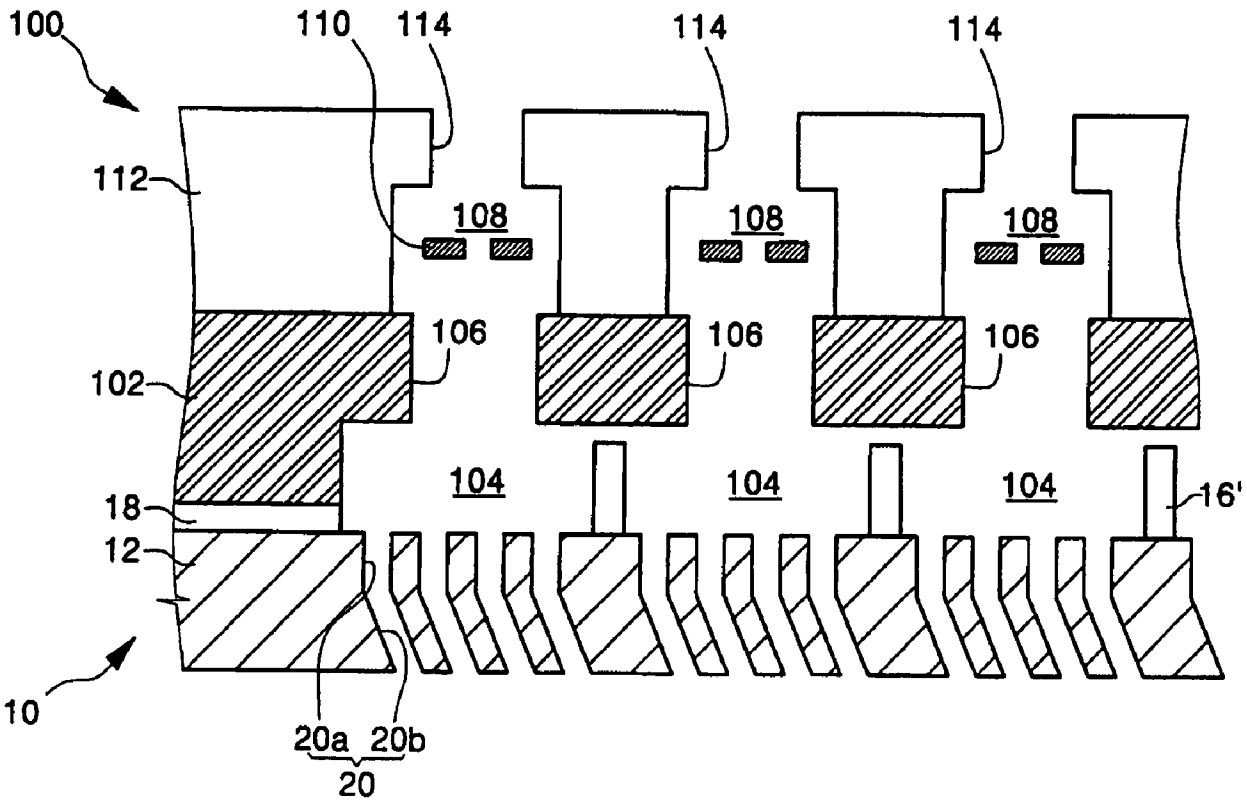
FIG. 2 is a cross-sectional view taken along the line I-I' of the ink jet head of FIG. 1.

FIG. 1 is an exploded plan view schematically illustrating an ink jet head according to an embodiment of the present general inventive concept, and FIG. 2 is a cross-sectional view taken along the line I-I' in FIG. 1.

Referring to FIGS. 1 and 2, the ink jet head includes a head chip 100 and a filter plate 10. The head chip 100 may include a head chip substrate 102 and a flow path structure 112 disposed on the head chip substrate 102 to define one or more ink chambers 108 and one or more nozzles 114.

The head chip substrate 102 may be a silicon substrate used in a semiconductor manufacturing process. The flow path structure 112 is disposed on the head chip substrate 102. The flow path structure 112 defines the ink chambers 108 that temporarily store the ink to be ejected to an exterior. The nozzles 114 that eject the ink are disposed on an uppermost part of the flow path structure 112 to be in fluid communication with the ink chambers 108, respectively. The flow path structure 112 may include a chamber layer to define sidewalls of the ink chambers 108, and a nozzle layer disposed on the chamber layer and having the nozzles 114 therein. Alternatively, as illustrated in FIG. 2, the flow path structure 112 may be formed as a single structure to define the ink chambers 108 and the nozzles 114. Although the nozzles 114 illustrated in FIG. 1 are disposed in two rows along a longitudinal direction of the head chip substrate 102, the nozzles 114 may alternatively be disposed in one row or three or more rows to increase resolution. The ink chambers 108 have pressure-generating elements disposed therein to generate pressure to eject the ink. The pressure-generating elements may be heaters 110 made of heat-generating resistors. As illustrated in FIG. 2, the heaters 110 may be located in the ink chambers 108 to be in direct contact with the ink in the ink chambers 108. An example of an ink jet head having a heater located in the ink chamber to be in direct contact with the ink is disclosed in U.S. Pat. No. 6,692,108.

A common feedhole 104 is formed on a lower region of the head chip substrate 102. As illustrated in FIG. 1, while a common feedhole 104 may be formed to correspond to each row of the nozzles 114, a single common feed hole 104 may be formed to include all the nozzles 114. The common feedhole 104 is in fluid communication with the ink chambers 108 through ink via-holes 106 formed at an upper region of the head chip substrate 102. That is, the common feedhole 104, the ink via-holes 106, the ink chambers 108, and the nozzles 114 may be located on the same axis along an ink flow direction.

Figure 3:
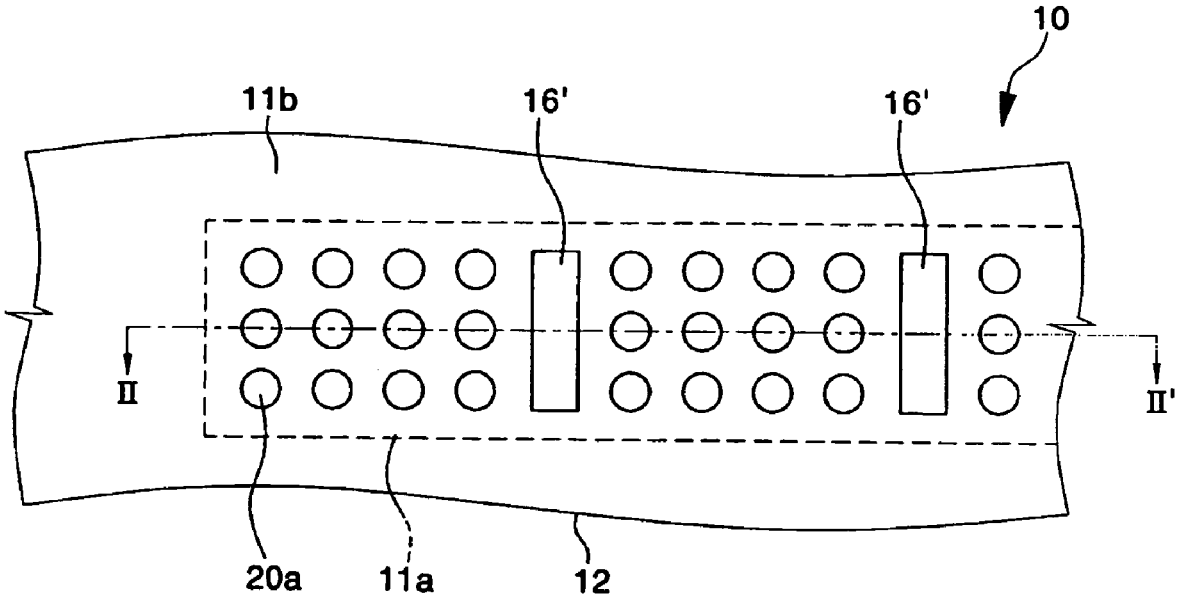
FIG. 3 is an enlarged plan view illustrating one end of a filter hole region of the ink jet head of FIG. 1.

FIG. 3 is an enlarged plan view illustrating one end of a filter hole region illustrated in FIG. 1. In this case, the filter plate 10 illustrated in FIG. 2 corresponds to a cross-sectional view taken along the line II-II' in FIG. 3.

Referring to FIGS. 1, 2, and 3, the filter plate 10 is disposed on a bottom surface of the head chip substrate 102. That is, the filter plate 10 may be interposed between the head chip 100 and an ink container (not shown). The filter plate 10 includes a filter substrate 12 having at least one filter hole region 11*a* overlapping with at least the common feedhole 104. The filter substrate 12 may be made of silicon, metal such as stainless steel, or a polymer. A periphery region of the filter substrate 12 defined by the filter hole region 11*a* may be provided as an adhesion region 11*b* to be adhered with the head chip substrate 102. Filter holes 20 extending through the filter substrate 12 are disposed in the filter hole region 11*a*. According to the present general inventive concept, the filter holes 20 extend through the filter substrate 12 of the filter hole region 11*a* and have an angled line shape. That is, each of the filter holes 20 includes an upper filter hole 20*a* formed at an upper portion of the filter substrate 12 to have a first angle with respect to the filter substrate 12, and a lower filter hole 20*b* formed at a lower portion of the filter substrate 12 to be connected to the upper filter hole 20*a* and having a second angle with respect to the filter substrate 12 different from the first angle. The first angle refers to an angle formed between the filter substrate 12 and a central axis of the upper filter hole 20*a*, and the second angle refers to an angle formed between the filter substrate 12 and a central axis of the lower filter hole 20*b*. The arrangement of the upper filter holes 20*a* illustrated in FIG. 3 is intended to be exemplary, and a cross-sectional area of the filter holes 20*a* and their arrangement may be varied and/or modified. The upper and lower filter holes 20*a* and 20*b* may have cylindrical shapes or tapered shapes having a cross-sectional area that increases as it goes toward a surface of the filter substrate 12 from a center portion of the filter substrate 12. In this case, the upper and lower filter holes 20*a* and 20*b* may have cross-sectional areas of about 1 $um^2$ (micrometer)~100 $um^2$.

The filter holes 20 may have angled line shapes rather than straight-line shapes. Therefore, the particles contained in the ink can be efficiently filtered even when the particles have a high aspect ratio, such as a particle with a long bar-like shape.

Partitions 16' to divide the filter holes 20 into predetermined units may be further disposed on the filter substrate 12. In this case, the filter holes 20 may be divided by the partitions 16', thereby grouping a plurality of filter holes corresponding to each of the ink chambers 108. That is, as illustrated in FIG. 2, the partitions 16' are disposed on the filter substrate 12 between the ink via-holes 106 to prevent the ink chambers 108 adjacent to each other from cross-talking when the ink is ejected. Each of the partitions 16' may be made of polymer, and have a rectangular shape and a length that extends across the filter hole region 11*a* in a latitudinal direction that is perpendicular to line II-II', as illustrated in FIG. 3. In addition, each partition 16' may be disposed to be in contact with a top surface of the common feedhole 104, and may have a length equal to a width of the filter hole region 11*a*. An adhesion layer 18 to adhere the filter plate 10 to the head chip substrate 102 may be disposed on the adhesion region 11*b*. The adhesion layer 18 may be made of the same polymer layer used for the partitions 16'.

As illustrated in FIGS. 1 and 2, the filter plate 10 may be adhered to a bottom surface of the head chip substrate 102 through the adhesion layer 18. In this case, the filter plate 10 may have an area substantially equal to the head chip substrate 102. Alternatively, the filter plate 10 may have an area that is smaller than the area of the head chip substrate 102, and the filter plate 10 may be adhered to the bottom surface of the head chip substrate 102 such that the area of the filter plate 10 is contained within the area of the head chip substrate 102.

Figure 10:
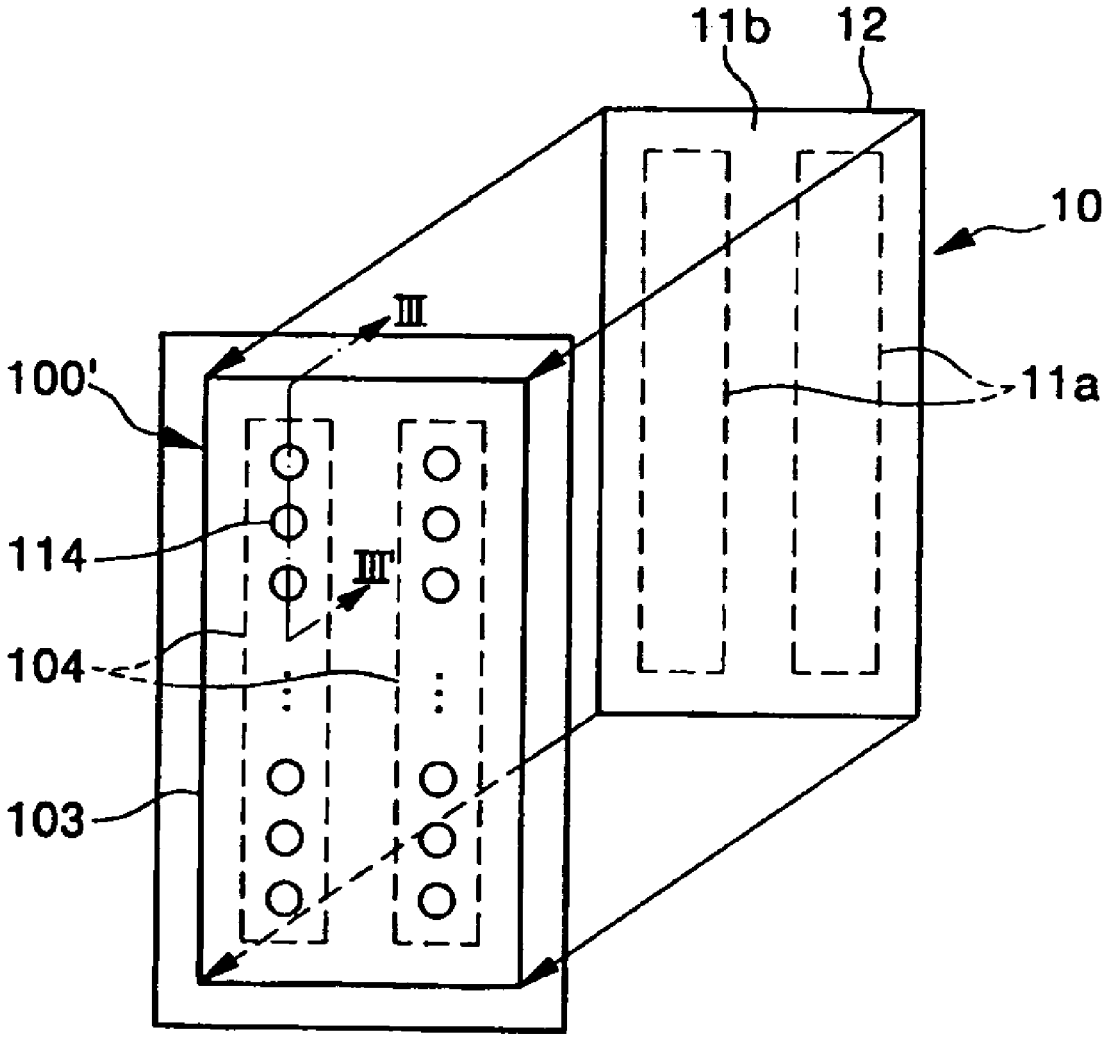
FIG. 10 is an exploded plan view schematically illustrating an ink jet head according to another embodiment of the present general inventive concept.
Figure 11:
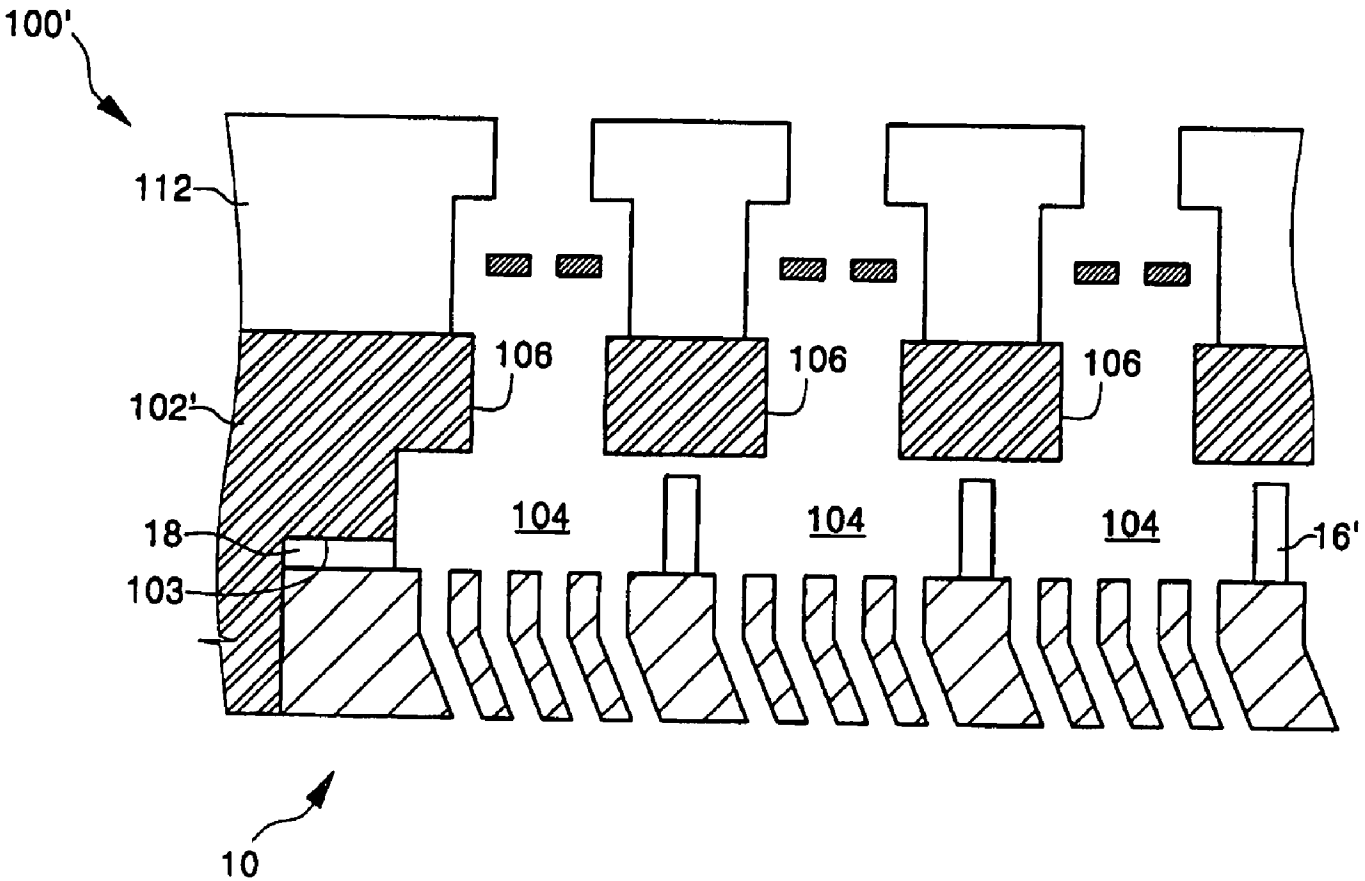
FIG. 11 is a cross-sectional view taken along the line III-III' of the ink jet head of FIG. 10.

FIG. 10 is an exploded plan view illustrating an ink jet head according to another embodiment of the present general inventive concept, and FIG. 11 is a cross-sectional view taken along the line III-III' of FIG. 10.

Referring to FIGS. 10 and 11, a head chip substrate 102' may include an adhesion stage 103 to be adhered to a filter plate 10 at a lower portion thereof. The adhesion stage 103 may be formed by patterning a bottom surface of the head chip substrate 102'. In this case, the filter plate 10 may be adhered to the adhesion stage 103 to be contained in the bottom surface of the head chip substrate 102'.

FIGS. 4 to 9 are cross-sectional views taken along the line II-II' of FIG. 3, which illustrate a method of fabricating a filter plate according to an embodiment of the present general inventive concept.

Figure 4:
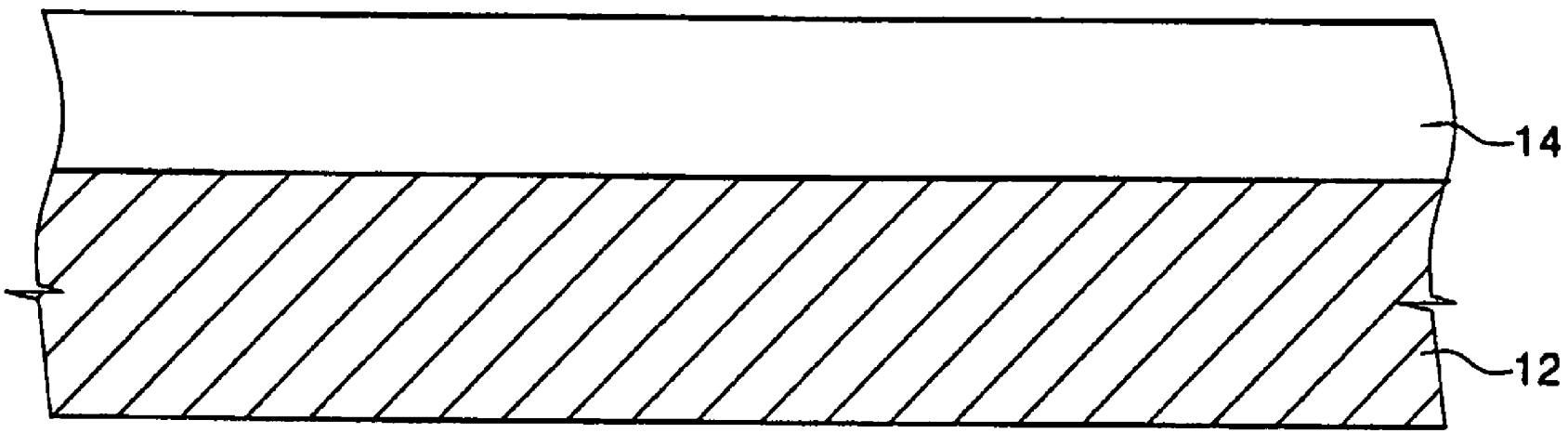
FIGS. 4 to 9 are cross-sectional views taken along the line II-II' of FIG. 3, which illustrate a method of fabricating a filter plate according to an embodiment of the present general inventive concept.

Referring to FIGS. 3 and 4, a filter substrate 12 having a filter hole region 11*a* is prepared. A periphery region defined by the filter hole region 11*a* may be provided as an adhesion region 11*b*. The filter substrate 12 may be made of any material on which laser machining can be performed. For example, the filter substrate 12 may be made of silicon, a metal such as stainless steel, or a polymer. A partition layer 14 may be formed on the filter substrate 12. The partition layer 14 may be formed of a polymer layer.

Figure 5:
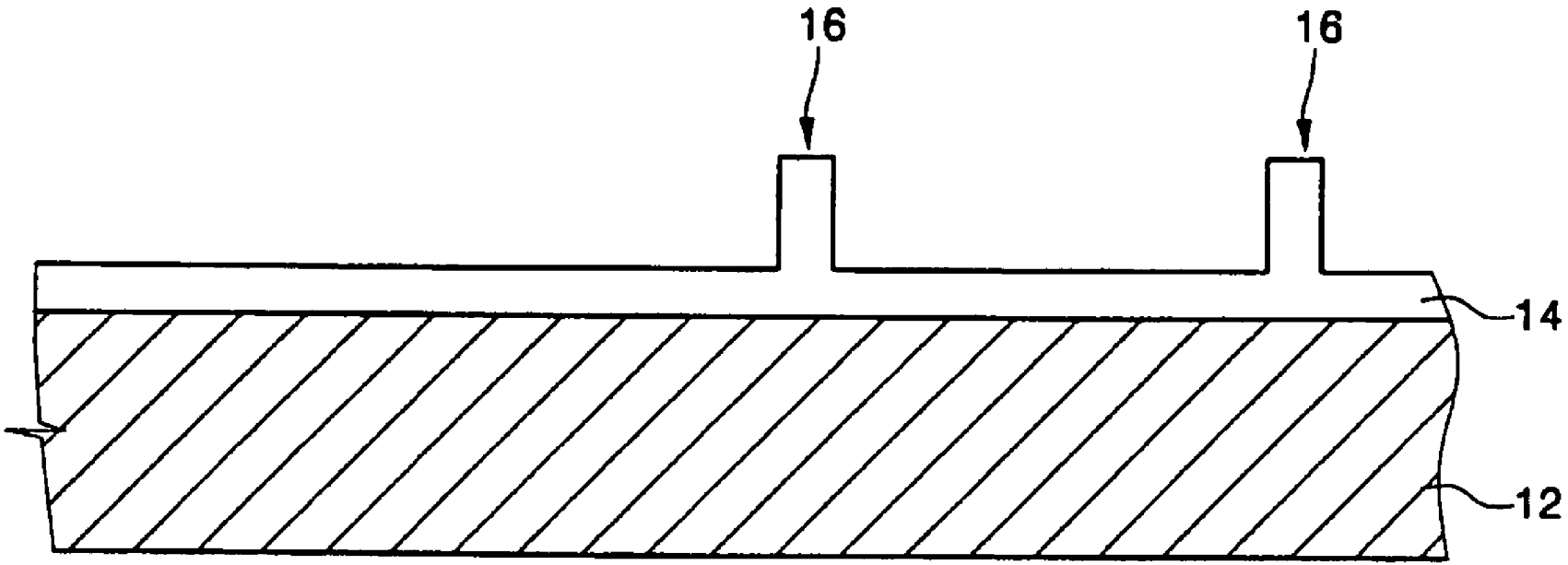

Referring FIGS. 3 and 5, the partition layer 14 is patterned to form preliminary partitions 16 in the filter hole region 11*a*. When the partition layer 14 is formed of a polymer layer, the partition layer 14 may be patterned by a photolithography process and a dry etching process. The drying etching process may be performed using oxygen plasma. As illustrated in FIG. 5, the partition layer 14 is partially etched to a predetermined thickness on the filter substrate 12 to define the preliminary partitions 16.

Figure 6:
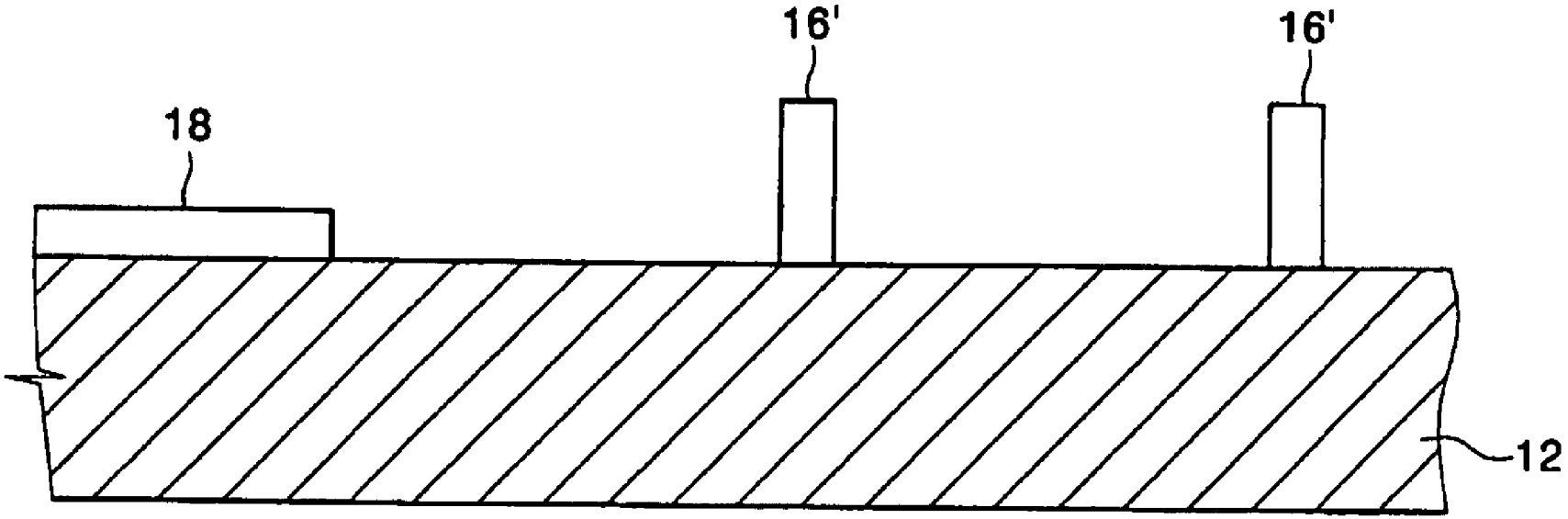

Referring to FIGS. 3 and 6, the partition layer 14 remaining on the filter substrate 12 in between the preliminary partitions 16 is selectively removed by etching performed using a mask pattern that covers the adhesion region 11*b* and the preliminary partitions 16 as an etch mask. The mask pattern may be a photoresist pattern. As a result, an adhesion layer 18 to be adhered with the head chip substrate 102 is formed on the adhesion region 11 b of the filter substrate 12, and partitions 16' are formed in the filter region 11*a*. Alternatively, the process of forming the preliminary partitions 16 illustrated in FIG. 5 may be omitted. In this case, the adhesion layer 18 may be formed on the adhesion region 11*b* after forming the partitions 16' or in the following process.

Figure 7:
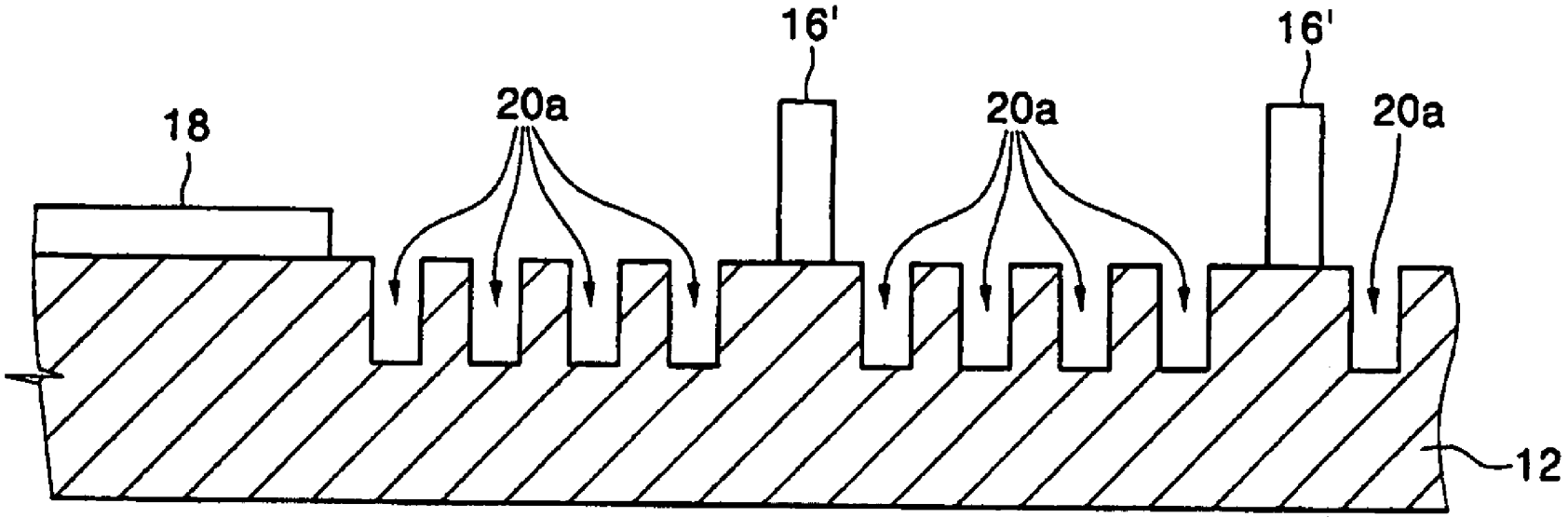

Referring to FIGS. 3 and 7, an upper portion (between the partitions 16' and the adhesion layer 18) of the filter substrate 12 of the filter hole region 11*a* is patterned from a top surface of the filter substrate 12 to form upper filter holes 20*a* having a predetermined depth from the top surface of the filter substrate 12 and having a first angle with respect to the filter substrate 12. The upper filter holes 20*a* may be patterned by a dry or wet etching process employing a mask pattern to expose a region, at which the upper filter holes 20*a* are to be formed, or a laser etching process. When the upper filter holes 20*a* are patterned using the dry or wet etching process, the first angle may be about 90° with respect to the filter substrate 12.

Figure 8:
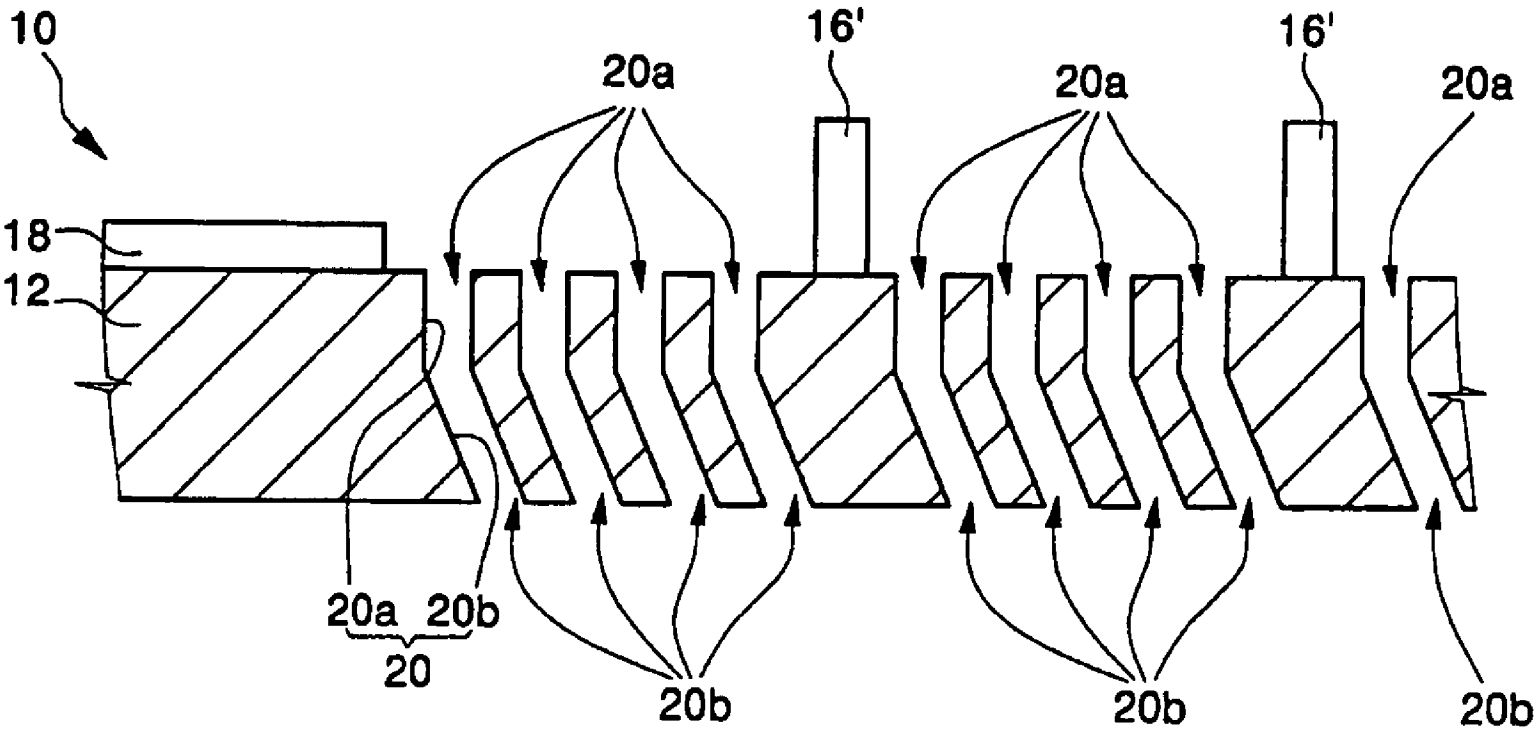

Referring to FIGS. 3 and 8, a lower portion of the filter substrate 12 is patterned from a bottom surface of the filter substrate 12 to form lower filter holes 20*b* connected to the upper filter holes 20*a* and having a second angle with respect to the filter substrate 12 and different from the first angle. As a result, the filter holes 20 extend through the filter substrate 12 and are formed to have an angled line shape. In order to form the lower filter holes 20*b* having the second angle inclined with respect to the filter substrate 12, a laser etching process may be used, as illustrated in FIG. 9.

Figure 9:
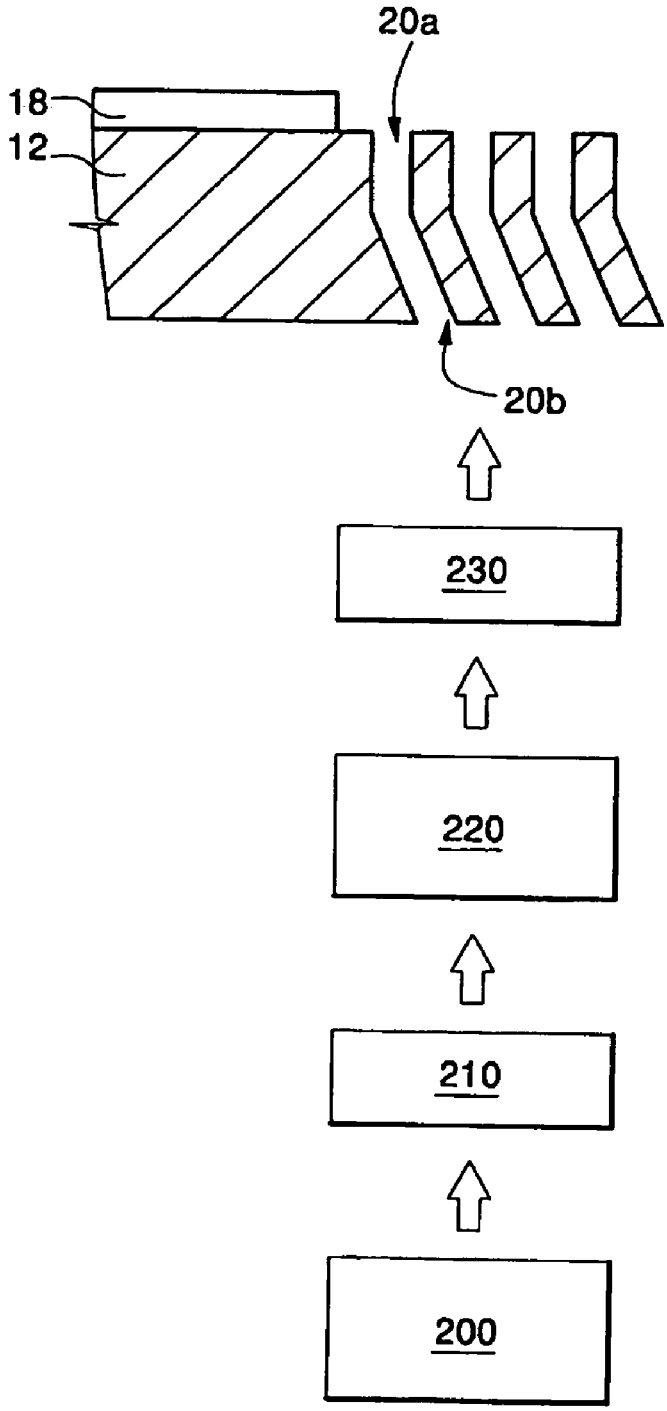

Referring to FIG. 9, a laser beam is emitted from a laser generator 200. A laser used to generate the laser beam may include an excimer laser, or any other laser used in MEMS (micro electro mechanical system) such as a DPSS (diode-pumped solid state) laser, or an FS (femto-second) laser. If the excimer laser is used, a beam homogenizer 210 is used to homogenize intensity of the laser beam generated by the laser generator 200. The laser beam that passes through the beam homogenizer 210 then passes through a mask box 220. At least one photo mask (not shown) having various feature diameters to define the lower filter holes 20*b* to have a desired angle and shape may be disposed in the mask box 220 in a predetermined arrangement. The at least one photo mask may be sequentially or simultaneously used. Next, the laser beam that passes through the mask box 220 is irradiated on a bottom surface of the filter substrate 12 through a projection lens 230.

The bottom surface of the filter substrate 12 is then etched by the laser beam. When the laser etching process is performed, it is possible to adjust an angle between the lower filter holes 20*b* and the filter substrate 12 and to form the lower filter holes 20*b* to have tapered shapes.

If a laser other than the excimer laser is used, since focusing of the laser beam is readily performed, it is possible to form the lower filter holes 20*b* using different focus spot sizes from each other and variations of fluence (amount of energy per unit area) of the laser beam. As a result, the lower filter holes 20*b* may be formed without using the mask box 200. Additionally, auxiliary devices such as a device to rotate the laser beam, a device to irradiate the laser beam in an inclined manner, or the like may be used.

The filter plate 10 fabricated by the process described above is attached to the bottom surface of the head chip substrate 102 through the adhesion layer 18. In accordance with the present general inventive concept, the filter plate 10 includes the filter holes having angled line shapes formed by employing the laser etching process. Therefore, it is possible to effectively filter particles contained in the ink even when the particles have a high aspect ratio, thereby preventing the nozzle or other parts of the ink flow path from being blocked due to the particles. Although the filter plate 10 is described with reference to the head chip 100 illustrated in FIGS. 2 and 11 that employs a so-called vertical feed method in which the ink chamber 108 is disposed at an upper portion of the common feedhole 104, the filter plate 10 may also be used with other arrangements between the head chip 100 and the ink container. That is, the filter plate 10 in accordance with the present general inventive concept is interposed between the head chip 100 and the ink container to filter the particles contained in the ink. Therefore, the filter plate 10 may alternatively be adapted to a head chip that employs a so-called horizontal feed method in which the ink chambers are disposed along both sides of the common feedhole.

As can be seen from the foregoing, the ink jet head in accordance with the present general inventive concept is capable of effectively filtering the particles having various shapes by employing the filter plate including the filter holes formed with angled line shapes using the laser etching process.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A filter plate to intercept particulates suspended in flowing ink, the filter plate usable with an ink jet head, the ink jet head presenting a substantially axial ink flow path, the filter plate comprising:

a filter substrate having a filter hole region; and filter holes extending through the filter substrate in the filter hole region, each filter hole including a first part and a second part that are angled with respect to each other so as to have angled line shapes, wherein the angled line shapes are asymmetric with respect to the substantially axial ink flow path.

2. The filter plate according to claim 1, the first part of each filter hole includes an upper filter hole formed to have a first angle with respect to the filter substrate at an upper portion of the filter substrate, and the second part of each filter hole includes a lower filter hole formed at a lower portion of the filter substrate to be connected to the upper filter hole and having a second angle with respect to the filter substrate different from the first angle.

3. The filter plate according to claim 1, wherein the filter substrate comprises one of silicon, metal, and polymer.

4. The filter plate according to claim 1, wherein the filter holes have cross-sectional areas of about 1 $um^2$~100 $um^2$.

5. The filter plate according to claim 1, further comprising:

partitions disposed on the filter substrate to divide the filter holes into predetermined units.

6. The filter plate according to claim 5, wherein the partitions are disposed in the filter hole region to have a length that extends across the filter hole region.

7. The filter plate according to claim 5, wherein the predetermined units of the filter holes correspond to ink chambers in the ink jet head.

8. The filter plate according to claim 1, wherein the filter substrate is interposed between the inkjet head and an ink container to filter particles contained in ink supplied by the ink container to the ink jet head.

9. The filter plate according to claim 8, wherein the filter substrate comprises an adhesion region around the filter hole region to be adhered to the ink jet head.

10. The filter plate according to claim 1, wherein the filter holes have a tapered shape and have a larger area at respective surfaces of the filter substrate.

11. An ink jet head, comprising:

one or more nozzles to eject ink;

one or more ink chambers in fluid communication with the one or more nozzles, respectively, the one or more ink chambers presenting a substantially axial ink flow path;

a head chip substrate having a common feedhole in fluid communication with the one or more ink chambers, the head chip substrate having a top surface and a bottom surface, the top surface being closer to the one or more nozzles;

a filter substrate disposed on the bottom surface of the head chip substrate and having one or more filter hole regions; and filter holes having a first part and a second part respectively forming asymmetric angles with respect to the substantially axial ink flow path.

12. The ink jet head according to claim 11, wherein each of the filter holes comprises:

an upper filter hole formed to have a first angle with respect to the filter substrate at an upper portion of the filter substrate; and a lower filter hole formed at a lower portion of the filter substrate to be connected to the upper filter hole and having a second angle with respect to the filter substrate different from the first angle.

13. The ink jet head according to claim 11, wherein the filter substrate comprises one of silicon, metal, and polymer.

14. The ink jet head according to claim 11, wherein the filter holes have cross-sectional areas of about 1 $um^2$~100 $um^2$.

15. The ink jet head according to claim 11, wherein the one or more filter hole regions overlap with the common feedhole to filter ink supplied thereto.

16. The ink jet head according to claim 11, further comprising:

one or more ink via-holes formed at an upper region of the head chip substrate to connect the common feedhole to the one or more ink chambers.

17. The ink jet head according to claim 16, further comprising:

one or more partitions disposed on the filter substrate between adjacent ink via-holes to divide the filter holes into predetermined units.

18. The ink jet head according to claim 17, wherein the one or more partitions are disposed in the one or more filter hole regions to have a length that extends across the one or more filter hole regions, respectively.

19. The inkjet head according to claim 11, wherein the filter holes have a tapered shape having an area that increases closer to surfaces of the filter substrate.

20. The ink jet head according to claim 11, wherein the common feedhole extends along a longitudinal direction and the one or more ink chambers extend along both sides of the common feedhole.

21. The ink jet head according to claim 11, wherein the filter substrate is contained within a bottom portion of the head chip substrate.

22. An ink jet head, comprising:

a substrate having an ink feed channel extending therethrough;

an ink flow structure disposed on the substrate including one or more ink chambers and one or more corresponding nozzles, the ink flow structure presenting a substantially axial ink flow path; and a filter including a plurality of filter holes disposed adjacent to the ink feed channel to supply filtered ink to the one or more ink chambers via the ink feed channel, the plurality of filter holes each including a first part and a second part that are angled with respect to each other and wherein the first part and the second part of the filter holes respectively form asymmetric angles with respect to the substantially axial ink flow path.

* * * * *